US005868584A

United States Patent [19]

Cook et al.

[11] Patent Number: 5,868,584

[45] Date of Patent: Feb. 9, 1999

[54] ELECTRICAL CONNECTOR FOR SHIELDED CABLE

[75] Inventors: Wayne G. Cook, Toronto; Dumitru Cotoara, North York, both of Canada

[73] Assignee: Amerace Ltd., Richmond Hill, Canada

[21] Appl. No.: 801,502

[22] Filed: Feb. 18, 1997

[51] Int. Cl.[6] ..... H01R 13/648

[52] U.S. Cl. ..... 439/98; 29/235; 29/450; 29/881; 29/869

[58] Field of Search ..... 439/98, 99, 587, 439/603, 447, 604, 578; 29/235, 450, 451, 881, 868, 869

[56] References Cited

U.S. PATENT DOCUMENTS

| | | | |
|---|---|---|---|
| 1,499,921 | 7/1924 | Goetz | 439/869 |
| 1,525,083 | 2/1925 | Meyer | 439/869 |
| 2,065,906 | 12/1936 | Parker et al. | 439/301 |
| 3,112,977 | 12/1963 | Long et al. | 439/585 |
| 3,179,914 | 4/1965 | Uberbacher | 439/295 |
| 3,596,234 | 7/1971 | Sapienza | 439/682 |
| 3,678,444 | 7/1972 | Stevens et al. | 439/578 |
| 3,880,487 | 4/1975 | Goodman et al. | 439/282 |
| 3,958,851 | 5/1976 | Evans | 439/295 |
| 3,976,352 | 8/1976 | Spinner | 439/578 |
| 4,233,731 | 11/1980 | Clabburn et al. | 29/859 |
| 4,654,241 | 3/1987 | Vallauri et al. | 428/36 |
| 4,685,758 | 8/1987 | Yoshida | 439/606 |
| 4,696,649 | 9/1987 | Smorzaniuk et al. | 439/98 |
| 4,762,501 | 8/1988 | Borgstrom et al. | 439/131 |
| 4,790,765 | 12/1988 | Ehrenfels et al. | 439/98 |
| 4,846,724 | 7/1989 | Sasaki et al. | 439/610 |
| 4,854,891 | 8/1989 | Kamei et al. | 439/462 |
| 5,273,457 | 12/1993 | Zell et al. | 439/581 |
| 5,304,067 | 4/1994 | Inaba et al. | 439/98 |
| 5,365,020 | 11/1994 | Vallauri et al. | 174/73.1 |
| 5,570,497 | 11/1996 | Luzzi | 29/868 |
| 5,618,190 | 4/1997 | Masuda et al. | 439/98 |
| 5,660,566 | 8/1997 | Ohsumi | 439/587 |

FOREIGN PATENT DOCUMENTS

| | | |
|---|---|---|
| 2406417 | 8/1974 | Germany . |
| 3743636 | 4/1992 | Germany . |

*Primary Examiner*—Paula Bradley
*Assistant Examiner*—Tho D. Ta
*Attorney, Agent, or Firm*—Riches, McKenzie & Herbert

[57] ABSTRACT

A method and connector to connect a first shielded cable to another electrical element, such as a second shielded cable, is disclosed. The first and second shielded cables comprise a cable shield applied over an insulated conductor. The connector comprises a contractible opening with a shield connector, such as a spring clip, located on the inner surface of the opening and contractible therewith. The opening can be resiliently deformable from a biased position, which permits easy insertion of the first cable, to an unbiased or contracted position, which can frictionally hold the first cable. To insert the first cable, the opening is biased to the biased position. Upon insertion of the cable to an inserted position, the opening is allowed to resiliently deform about the first cable, such that the first cable is frictionally held in the opening and the shield connector is in electrical contact with the cable shield of the first cable. A shield conductor, such as a wire, is electrically connected to the shield connector and extends to the exterior of the housing for electrical connection to another electrical element, such as the shield of the second cable or to ground. An electrical contact is attached to the insulated conductor which can mate to an electrical contact on the second conductor thereby electrically connecting the conductors.

22 Claims, 7 Drawing Sheets

ELECTRICAL CONNECTOR FOR SHIELDED CABLE

FIELD OF THE INVENTION

This invention relates to an electrical connector for connecting shielded or screened cables.

BACKGROUND OF THE INVENTION

In the past, there have been many different types of electrical connectors to connect shielded cables. However, the prior art connectors all suffer from the disadvantage that a separate electrical connection must be made to the shield before the shielded cable is inserted into prior art connectors. In other words, a shield conductor must be electrically connected to the shield of the shielded cables prior to insertion of the cable into the prior art connectors. It is also often necessary to attach an electrical contact, such as a plug or receptacle, to the conductor of the shielded cable. The shielded cable must then be inserted into the prior art connectors, taking care not to dislodge the shield conductor from the shield or the electrical contact from the conductor.

Furthermore, the shield conductor must be electrically insulated from the conductor and the electrical element. This requires that the shield conductor and electrical contact extend from two different openings in the connector, thereby requiring the person assembling the connector to guide the electrical contact out one opening in the connector, and guide the shield connector out a separate opening in the housing. This is made particularly difficult if the connector is to be waterproof because the openings through which the electrical contacts and shield conductors must pass are small and well insulated.

Accordingly, there has been a need in the art for an improved connector and method for connecting the shield conductor to a shield cable which overcomes the disadvantages of the prior art. In particular, there has been a need in the art for a connector which does not require an electrical connection to the shield to be made before insertion of the cable into the connector, thereby avoiding the need to guide the shield conductor through an opening in the housing during installation. In addition, there has been a need in the art for a connector which has a shield connecting device located inside the connector, such that the shield conductor is automatically electrically connected to the shield of the shielded cable when the shielded cable is inserted into the connector.

SUMMARY OF THE INVENTION

Accordingly, it is an object of this invention to at least partially overcome the disadvantages of the prior art. Also, it is an object of this invention to provide an improved type of electrical connector for connecting shielded cables such that an electrical connection need not be made to the shield before insertion of the cable into the connector. It is also an object of this invention to provide an improved connector having a shield connecting device located inside the connector, such that the shield conductor is automatically electrically connected to the shield of the shielded cable when the shield is inserted into the connector.

Accordingly, in one of its objects, this invention resides in an electrical connector for connecting a first shielded cable to a first electrical element, said first shielded cable comprising an insulated conductor having an outer diameter and a cable shield applied over the insulated conductor, said electrical connector comprising: a first longitudinally extending connector housing; a resilient opening extending longitudinally into a first end of the connector housing for longitudinally receiving the first shielded cable, said resilient opening having an inner diameter and being resiliently deformable from a biased position, permitting insertion of the first cable, to an unbiased position, wherein the inner diameter is smaller than the outer diameter of the insulated conductor; shield connecting means located on an inside surface of said resilient opening at a longitudinal position along said first connector housing; shield coupling means electrically connected to the shield connecting means and electrically connectable to a second electrical element; wherein the resilient opening is biased to the biased position to permit insertion of the first cable into the connector housing, and, wherein upon insertion of the first cable to an inserted position, the resilient opening is permitted to resiliently deform about the first cable such that the first cable is frictionally held in said resilient opening and the shield connecting means is in electrical contact with the cable shield of the first cable.

In a further aspect, the present invention resides in an electrical connector for connecting a first shielded cable to a first electrical element, said first shielded cable having an outer diameter and comprising an insulated conductor and a cable shield applied over the insulated conductor, said electrical connector comprising: a connector housing; contractible opening means extending longitudinally into a first end of the connector housing for longitudinally receiving the first shielded cable, said contractible opening means having an inner dimension permitting insertion of the first cable; shield connecting means located on an inside surface of said opening means at a longitudinal position along said first connector housing; shield coupling means electrically connected to the shield connecting means and electrically connectable to a second electrical element; and wherein the first cable is longitudinally inserted into the contractible opening means, and, wherein upon insertion of the first cable to an inserted position, the contractible opening is contracted about the first cable such that the first cable is frictionally held in said contractible opening and the shield connecting means is in electrical contact with the cable shield of the first cable.

In a further aspect, the present invention resides in a method for connecting a first shielded cable to a first electrical element, said first shielded cable comprising an insulated conductor and a cable shield applied over the insulated conductor, said method comprising the steps of: inserting said first cable into a contractible opening of a connector housing, said opening extending longitudinally into a first end of the connector housing and having an initial inner dimension permitting insertion of the first cable, said opening further having shield connecting means formed on an inside surface of said opening at a longitudinal position along said first connector housing, said shield connecting means being electrically connected to the shield coupling means and electrically connectable to a second electrical element; when the first cable is in an inserted position in the connector housing, contracting the contractible opening about the first shielded cable such that the first cable is frictionally held in said contractible opening and the shield connecting means is in electrical contact with the cable shield of the first shielded cable; electrically connecting the shield coupling means to the second electrical element; and electrically connecting the insulated conductor of the first cable to the first electrical element.

In a still further aspect, the present invention resides in a method for making an electrical connector which can connect a shield conductor to the shield of a shielded cable, said shielded cable comprising an insulated conductor having an outer diameter and a cable shield applied over the insulated conductor, said method comprising the steps of: attaching the shield conductor to a clip means; wrapping the clip means around a rigid member such that the clip means can be moved axially with the rigid member; inserting the shield conductor, clip means and rigid member into a first resilient opening extending longitudinally into the electrical connector, such that the first resilient opening is resiliently deformed by the rigid member from an unbiased position, wherein an inner diameter of the opening is smaller than the outer diameter of the insulated conductor, to a biased position, permitting insertion of the first cable; wherein upon insertion of the shielded cable into the opening, the rigid member can be removed permitting the resilient opening to resiliently deform about the shielded cable such that the shielded cable is frictionally held in said resilient opening and the clip means is in electrical contact with the cable shield.

Further aspects of the invention will become apparent upon reading the following detailed description and drawings which illustrate the invention and preferred embodiments of the invention.

BRIEF DESCRIPTION OF THE DRAWINGS

In the drawings, which illustrate embodiments of the invention.

DETAILED DESCRIPTION OF THE PREFERRED EMBODIMENTS

Figure 1B:
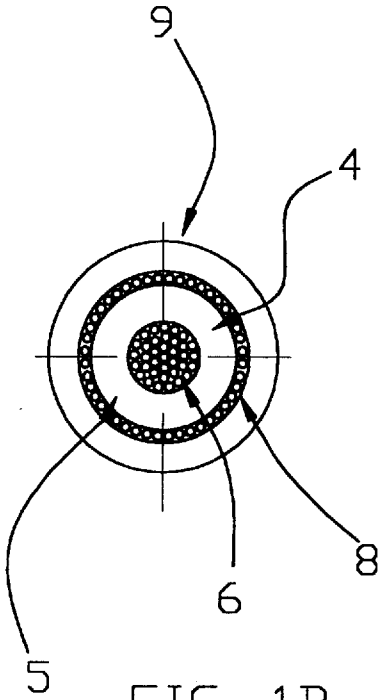
FIG. 1B shows a front view of a shielded cable with the shield and conductor exposed.
Figure 1A:
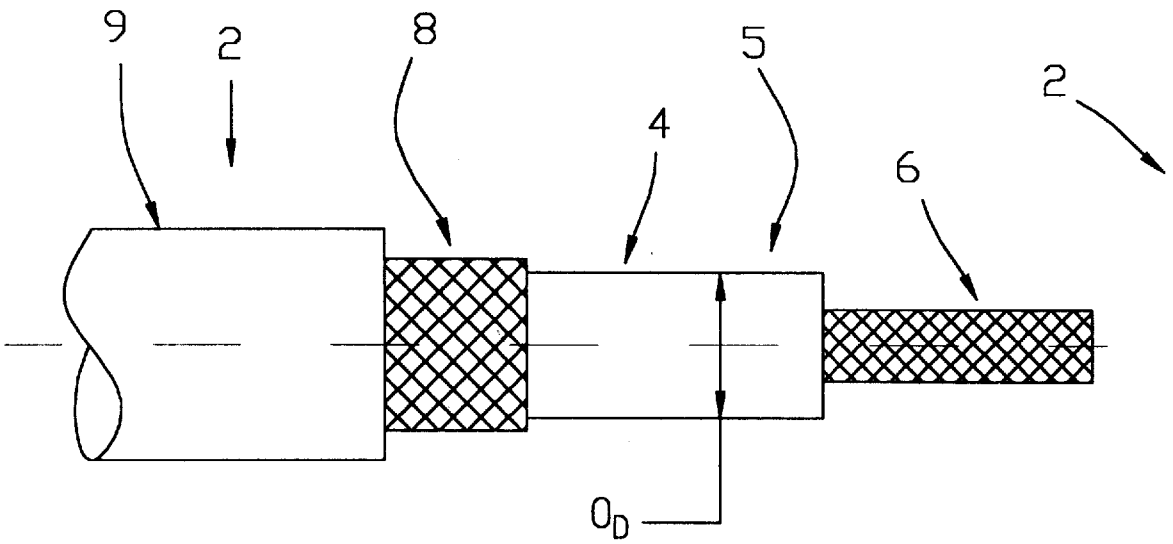
FIG. 1A shows a side view of a shielded cable with the shield and conductor exposed.

FIG. 1A shows a side view of a shielded cable 2. FIG. 1B is a front view of the shielded cable 2 shown in FIG. 1A. The shielded cable 2 shown in both FIGS. 1A and 1B has been stripped to expose the insulated conductor 4 and cable shield 8. The insulated conductor 4 comprises insulation 5 applied over conductor 6. The cable shield 8 is applied over the insulated conductor 4. The insulated conductor 4 has an outer diameter shown in drawing FIG. 1A as $O_D$. The entire shielded cable 2 generally has a jacket or outer insulation 9.

Figure 2A:
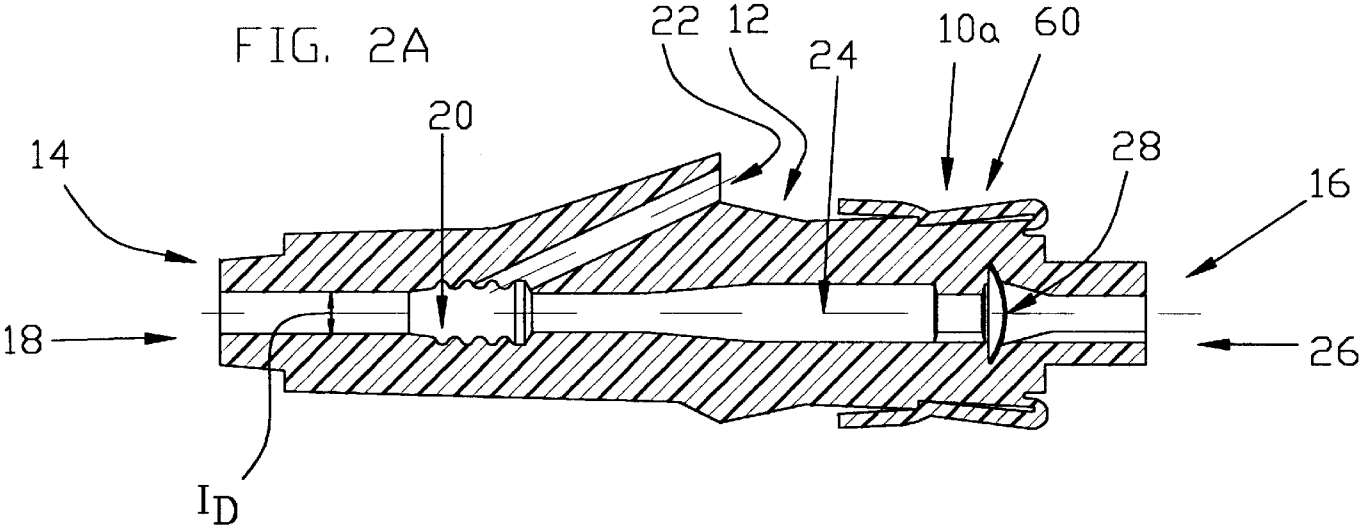
FIG. 2A is a cross section of a connector housing for a pin contact before insertion of the pin, stretcher and clip.
Figure 2B:
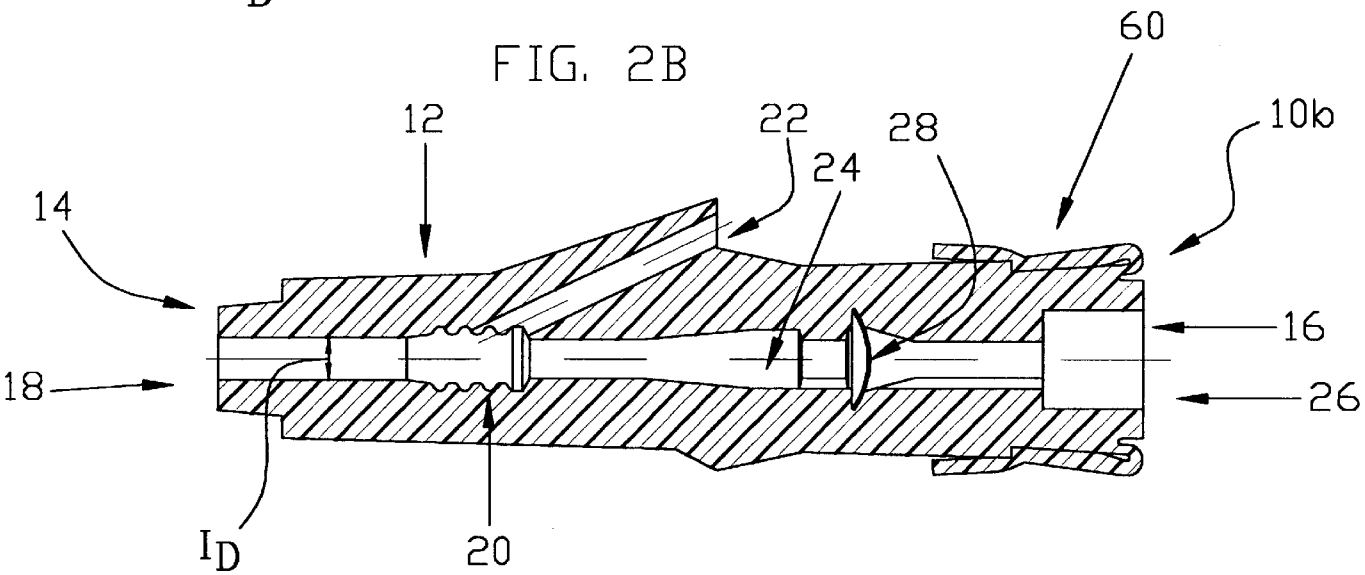
FIG. 2B is a cross section of a connector housing for a socket contact before insertion of the socket contact, stretcher and clip.

FIGS. 2A and 2B show connectors 10*a* and 10*b*, respectively, according to one embodiment of the invention. The connector 10*a* shown in FIG. 2A is for a pin electrical contact and the conductor lob shown in FIG. 2B is for a socket electrical contact which mates with the pin electrical contact. Whether connector 10*a* or 10*b* will be used will depend on the electrical element to be contained within the connector 10*a* or 10*b*. The features of the invention are common to both the pin connector 10*a* and the socket connector 10*b*. The pin connector 10*a* shown in FIG. 2A will now be described, but the same comments and the same reference numerals apply to the corresponding features in the socket connector 10*b* shown in FIG. 2B.

The pin connector 10*a* comprises a longitudinally extending connector housing 12. The connector housing 12 has a first end 14 and a second end 16.

At the first end 14, a first resilient opening 18 extends longitudinally into the connector housing 12 for longitudinally receiving the shielded cable 2. The first resilient opening 18 has an inner dimension, shown generally in FIG. 2A as inner diameter $I_D$ The resilient opening 18 is resiliently deformable from an unbiased position, shown in FIG. 2A, wherein the inner diameter $I_D$ is smaller than the outer diameter $O_D$ of the shielded cable 2, to a biased position, wherein the inner diameter $I_D$ is larger than the shielded cable 2, as shown in FIGS. 4A, 4B and 5, so as to permit insertion of the shielded cable 2 into the connector housing 12.

Figure 4A:
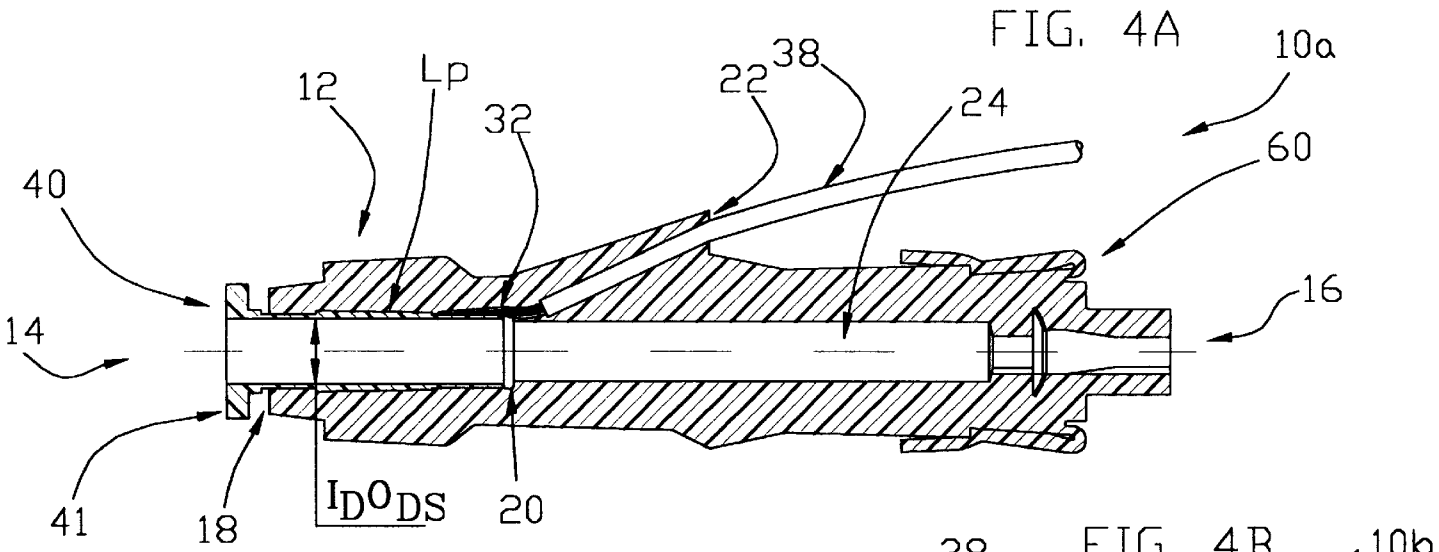
FIG. 4A is a cross section of a connector housing for a pin contact before insertion of the pin, but after insertion of the stretcher and clip.
Figure 4B:
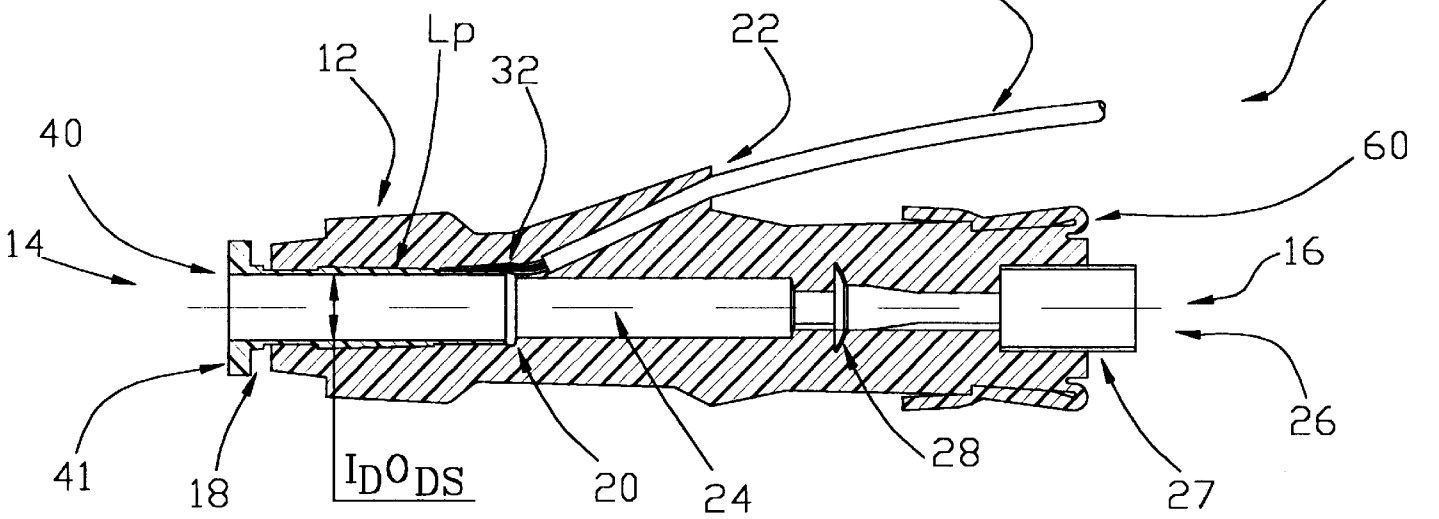
FIG. 4B is a cross section of a connector housing for a socket contact which mates with the pin housing, before insertion of the socket contact, but after insertion of the stretcher and clip.
Figures 5A, 5B:
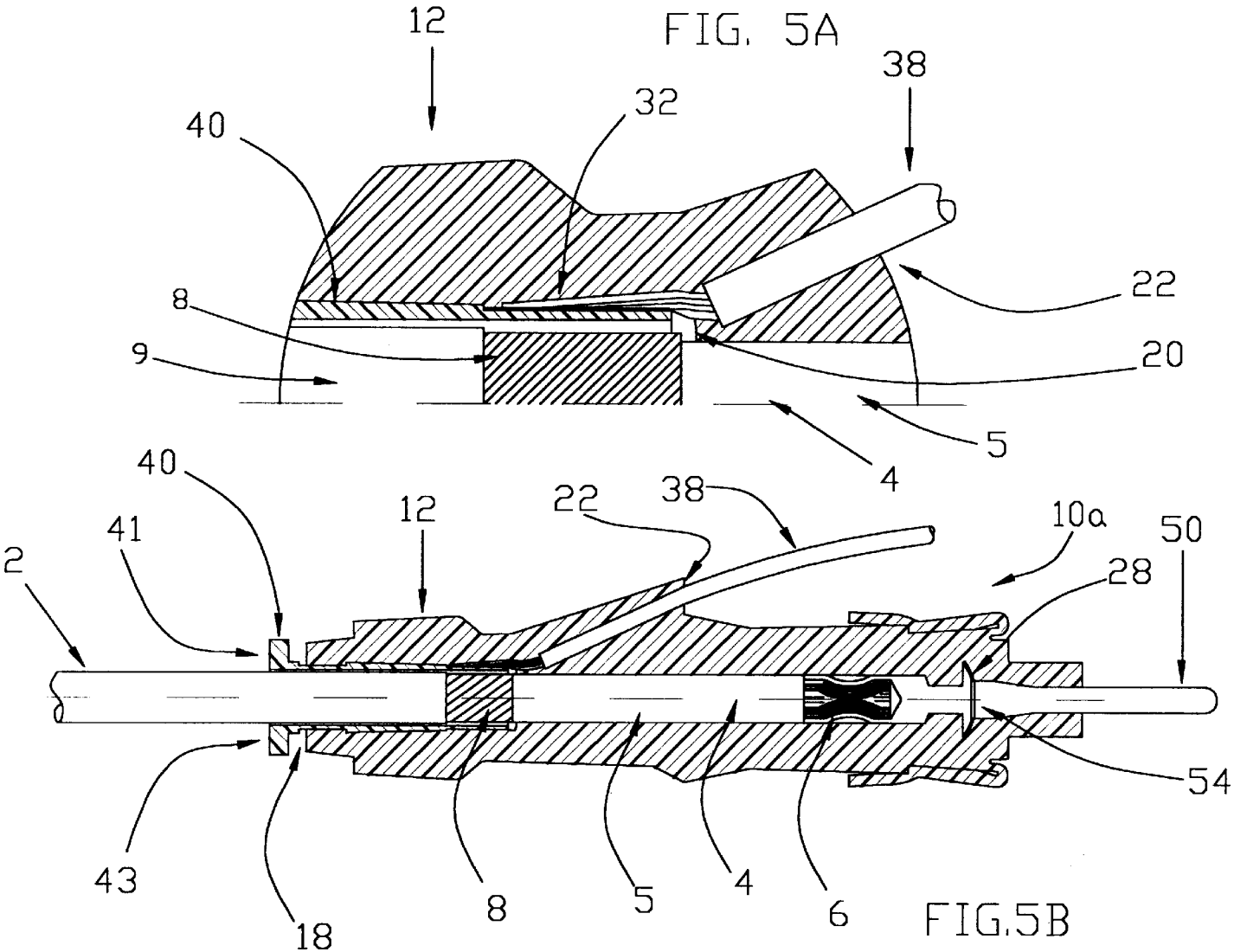
FIG. 5A is an enlarged detail drawing showing the stretcher, clip and cable inserted in a pin housing.
FIG. 5B is a cross section of a pin connector housing shown in FIG. 5A with the pin in the inserted position.

At the time of manufacture, the resilient opening 18 is biased to the biased position, shown in FIG. 4A, 4B and 5, so that the shielded cable 2 can be inserted into the connector housing 12. Upon insertion of the cable 2 to an inserted position, shown in FIG. 5B, the resilient opening 18 is permitted to resiliently deform about the outer insulation 9, shield 8 and insulated conductor 4 of the cable 2 such that the cable 2 is frictionally held in the resilient opening 18 by an interference fit.

The resilient opening 18 has ribbed protrusions 20 which give the resilient opening 18 greater resiliency localized at the ribbed protrusions 20. In addition, the ribbed protrusions 20 cause the resilient opening 18 to have less friction in an axial direction at the location of the ribbed protrusions 20.

Pin housing 12 further comprises a second resilient opening 22. The second resilient opening 22 extends from the first opening 18 at a location proximate the ribbed protrusions 20.

The pin housing 12 further comprises a passage 24 extending from the first resilient opening 18 to a third opening 26 at the second end 16. A lock washer 28 is located at the third opening which acts as a locking mechanism to lock the shielded cable 2 in the inserted position, as further described below. The lock washer 28 is imbedded in the pin housing 12.

Figures 3A, 3B, 3C:
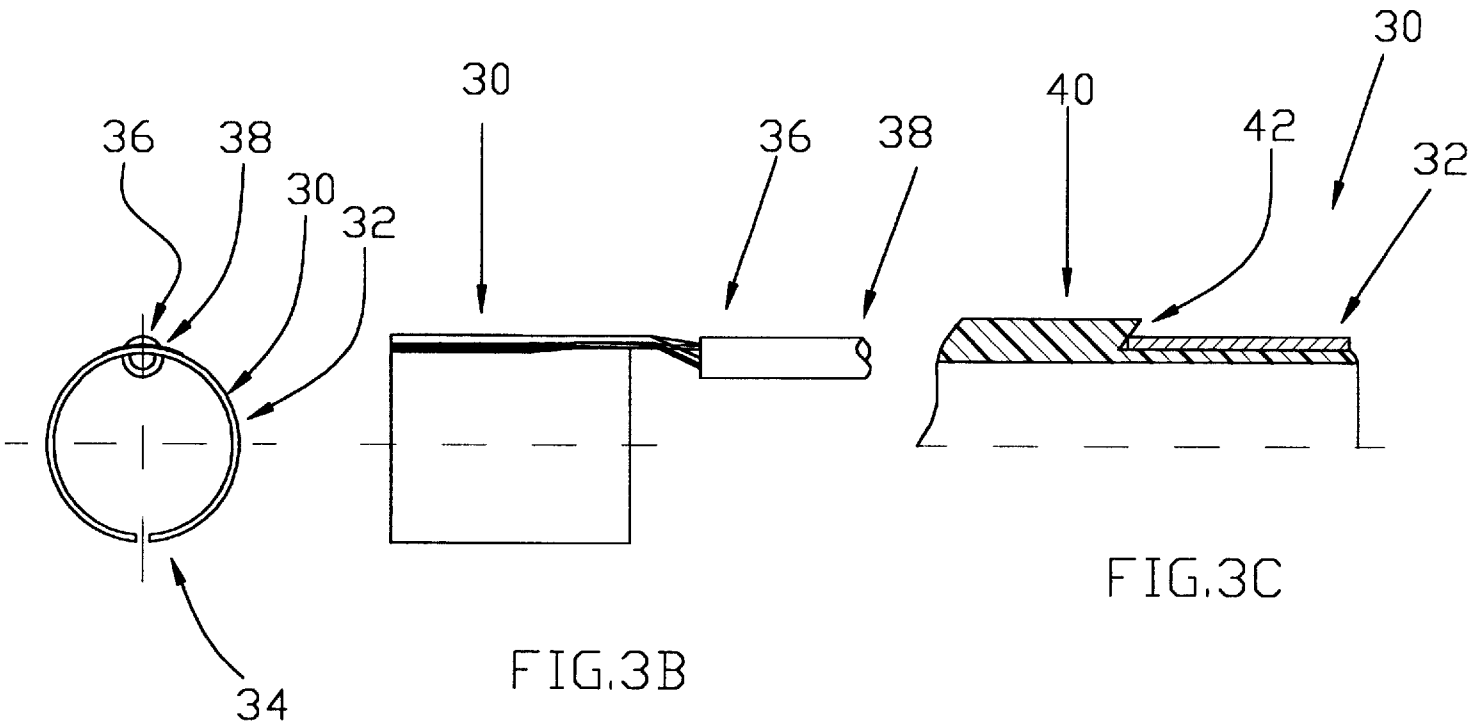
FIG. 3A shows a front view of a clip and shield conductor used in one embodiment of the invention.
FIG. 3B shows a side view of the clip and shield conductor shown in FIG. 3A.
FIG. 3C shows a side view of the clip wrapped around a stretcher according to one embodiment of the invention.

The pin connector 10*a* further comprises a shield connecting device, shown generally in FIGS. 3A, 3B and 3C by reference numeral 30. In a preferred embodiment, as shown in FIGS. 3A, 3B and 3C, the shield connecting device 30 comprises a resilient spring clip 32. The spring clip 32 is made from a conductive metal which can be resiliently deformed. Furthermore, the spring clip 32 preferably has a slit 34 running axially along the clip 32 to further increase the resiliency of the clip 32.

The pin connector 10*a* further comprises a shield coupling device shown generally by reference numeral 36 in FIGS. 3A and 3B. The shield coupling device 36 is electrically connected to the shield connecting device 30, which in the embodiment shown in FIGS. 3A and 3B corresponds to the clip 32. The shield coupling device 36 is also electrically connectible to a second electrical element, such as another shield coupling device 36. In a preferred embodiment, as shown in FIGS. 3A and 3B, the shield coupling device 36 is a shield conductor 38, such as an insulated electrical cable.

The socket connector 10*b* also comprises a shield connecting device 30 and a shield coupling device 36, which preferably are a clip 32 and shield conductor 38, respectively, as shown in FIGS. 3A and 3B.

FIG. 3C shows a portion of a stretcher 40, which is also shown in FIGS. 4A and 4B. The stretcher 40 is preferably a rigid member having an outer diameter $O_{DS}$ which corresponds to the inner diameter $I_D$ of the resilient opening 18 in the biased positinion The stretcher 40 acts as a biasing device to bias the resilient opening 18 to the biased position, shown in FIGS. 4A and 4B. In a preferred embodiment, the stretcher 40 is also used to locate the clip 32 at an inner surface of the resilient opening 18 and a longitudinal position $L_P$ along the housing 12. The stretcher 40 comprises a shoulder 42, as can best be seen in FIG. 3C, to move the clip 32 axially along the housing 12. The clip 32 is wrapped around the stretcher 40 such that the clip 32 abuts the shoulder 42. As the stretcher 40 is pushed into the resilient opening 18 and moves the clip 32 to the longitudinal position $L_P$, the shield conductor 38 can simultaneously be inserted into the second resilient opening 22 and pulled therethrough to extend to an outer surface of the housing 12. The shield conductor 38 is frictionally held in place in the second resilient opening 22 by an interference fit.

Preferably, the stretcher 40 comprises an integral actuating flange 41 extending along the perimeter of the external end of the stretcher 40. The integral actuating flange 41 facilitates axial removal of the stretcher 40 into and out of the resilient opening 18.

Figure 6:
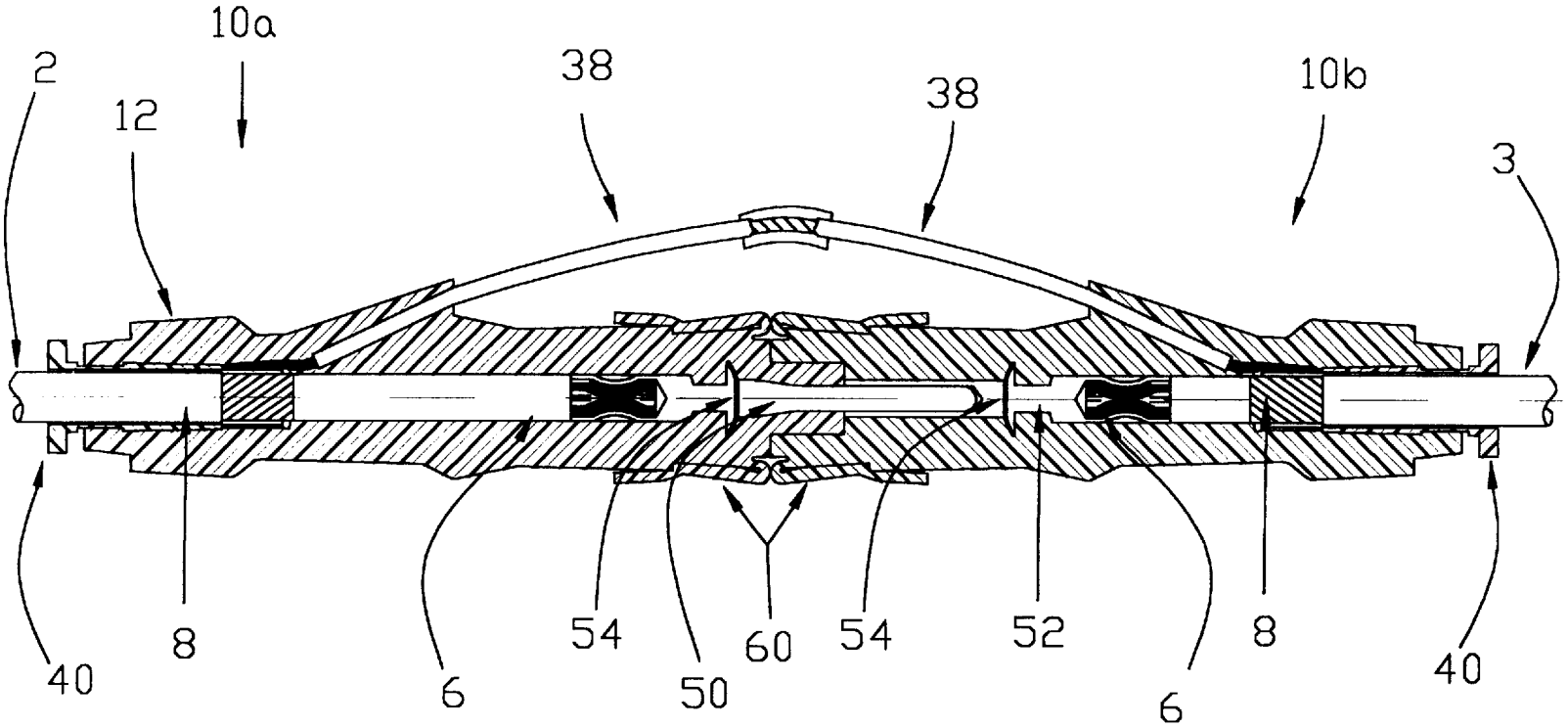
FIG. 6 shows a connector assembly with a pin and pin contact mated to a socket and socket contact and the shields electrically connected to each other.

The stretcher 40 has an opening 43 which communicates with the first resilient opening 18. The cable 2 can be inserted into the stretcher opening 43 and then into the first resilient opening 18, through the passage 24, and out the third resilient opening 26. When the cable 2 is fully inserted into an inserted position, as shown in FIGS. 5B and 6, the stretcher 40 can be removed from the first resilient opening 18. The clip 32 remains at the longitudinal position $L_P$ when the stretcher 40 is removed and the clip 32 resiliently deforms with the first resilient opening 18 to electrically contact the shield 8 of the cable 2. In this way, after the stretcher 40 has been removed, the cable 2 is frictionally held in the first resilient opening 18 and the clip 32 is in electrical contact with the shield 8.

The clip 32 remains at the longitudinal position $L_P$ when the stretcher 40 is removed because the clip 32 is attached to the shield conductor 38, which is held in the second resilient opening 22. Also, the axial frictional forces of the first resilient opening 18, beyond the ribbed protrusions 20, assist in keeping the clip 32 in abutting relation to the ribbed protrusions 20. Furthermore, the ribbed protrusions 20 cause the first resilient opening 18 to be more resilient in the vicinity of the ribbed protrusions 20 keeping the clip 32 in abutting relation to the ribbed protrusions 20 and in electrical contact with the shield 8 when the stretcher 40 is removed.

FIGS. 4*a* and 4*b* show the connectors 10*a* and 10*b* in the assembled or manufactured condition. The connectors 10*a* and 10*b* shown in FIGS. 4*a* and 4*b* are in the form they could be shipped to the location where they would be used to connect shielded cable 2. As shown in FIG. 4*b*, the housing 12 for the socket connector 10*b* preferably comprises a protective sleeve 27 for shipping purposes and is removed at installation in the field. The insertion of the cable 2 in the resilient opening 18 would also take place in the field. Upon insertion of the cable 2 into the resilient opening 18 to the inserted position, as shown in FIGS. 5B and 6, the stretcher 40 can be removed from the resilient opening 18 so that the opening resiliently deforms about cable 2 to frictionally hold it in place and the clip 32 is placed in electrical contact with the shield 8.

Generally, the cable 2 comprises an outer insulating shield 9, shown in FIG. 1A and 1B. In these cases, it is preferred that a portion of the shield 8 is exposed such that the exposed portion is coincident with the longitudinal position $L_P$ of the clip 32 when the conductor 6 is in the inserted position, as shown in FIGS. 5A and 5B. It is understood that the shield 8 can be exposed in any known manner, or that a different type of shield connecting device 30, other than a clip 32, could be used to ensure that the clip 32 and shield 8 are in electrical contact when the stretcher 40 is removed.

As shown in FIG. 5B, a pin contact 50 is connected to the conductor 6. The pin contact 50 is generally connected to the conductor 6 before insertion of the conductor into the housing 12. The pin contact 50 allows the conductor 6 to be electrically connected to another socket contact 52. FIG. 6 shows a pin contact 50 connected to a socket contact 52.

As further shown in FIG. 5B, the pin contact 50 has a radial groove 54 at a location which coincides with the lock washer 28. When the cable 2 is inserted into the inserted position, as shown in FIG. 5B, the axial position of the radial groove 54 coincides with position of the lock washer 28. The lock washer 28 engages the radial groove 54 of the pin contact 50 to thereby lock the cable 2 in the inserted position. The socket contact 52 also has a radial groove 54 which engages a lock washer 28 in embedded in the housing 12 of the socket connector 10*b*.

The lock washer 28 operates in addition to the interference fit at the first resilient opening 18 and passage 24. Also, the third resilient opening 26 has an interference fit with the pin contact 50, further ensuring that the cable 2 remains in the inserted position. However, the interaction of the radial groove 54 and the lock washer 28 is generally stronger because it constitutes a metal-on-metal contact.

FIG. 6 shows a pin connector 10*a* connected to a socket connector 10*b*. A second shielded cable 3, similar to shielded cable 2, is shown inserted into the socket connector 10*b*. Furthermore, connector 10*b* has a shield conductor 38 connected to the shield 8 of the second shielded cable 3. The connection shown in FIG. 6 would be the type of connection used when two shielded cables are spliced and connected to each other.

As shown in FIG. 6, a socket contact 52 has been connected to the second shielded cable 3. The socket contact 52 connected to the conductor 6 of the second shielded cable 3 can be mated with the pin contact 50 attached to the conductor 6 of the first shielded cable 2. In this way, the conductors 6 of the two cables 2, 3 are electrically connected. Likewise, the shield conductors 38 from the two connectors, namely the pin connector 10a and the socket connector 10*b*, are electrically coupled together, thereby electrically connecting the shields 8 from the two cables 2, 3. Finally, the housings 12 of the two connectors 10*a*, 10*b* are mated, also by an interference fit, to mechanically connect the connectors 10*a* and 10*b* and to insulate the electrical connection of the pin contact 50 with the socket contact 52. The interference fit of the two housings 12 results from the housing 12 of the socket connector 10*b* being sized to be slightly smaller than the pin housing 12 of the pin connector 10*a*, as shown in FIG. 6.

To further insulate the connection of the pin contact 50 with the socket contact 52, the connectors 10*a*, 10*b* each have a retractable sleeve 60. In FIG. 6, both retractable sleeves 60 are shown in the retracted position. The retractable sleeve 60 of one connector, either 10*a* or 10*b*, can be folded over the retractable sleeve 60 of the other connector 10*a* or 10*b*. If one of the retractable sleeves 60 of one of the connectors 10*a* or 10*b* is stretched over the retractable sleeve 60 of the other connector 10*b* or 10*a*, a second interference fit results.

It is apparent that the connectors 10*a* and 10*b* are waterproof in that no water or moisture can enter through the first resilient opening 18, the second resilient opening 22 or the third resilient opening 26 once the stretcher 40 has been removed. Each of these openings form an interference fit and provide a good insulation against water and dirt. Furthermore, the interference fit between the pin connector 10*a* and the socket connector 10*b* further insulates the connection of the pin contact 50 and the socket contact 52. In addition, passage 24 resiliently deforms about the shield 8 and insulated conductor 4 to insulate the shield 8 from the electrical contacts 50, 52. Finally, the retractable sleeves 60 provide additional insulation of the connection of the pin contact 50 and the socket contact 52.

It is understood that the connectors 10*a*, 10*b* can be used to connect the conductor 6 and the shielded cable 8 of the cables 2, 3 to any type of electrical element. In the embodiment shown in FIG. 6, the pin connector 10*a* is connecting the conductor 6 and the shield 8 from the first cable 2 to the conductor 6 and the shield 8, respectively, of the second cable 3.

Figure 7:
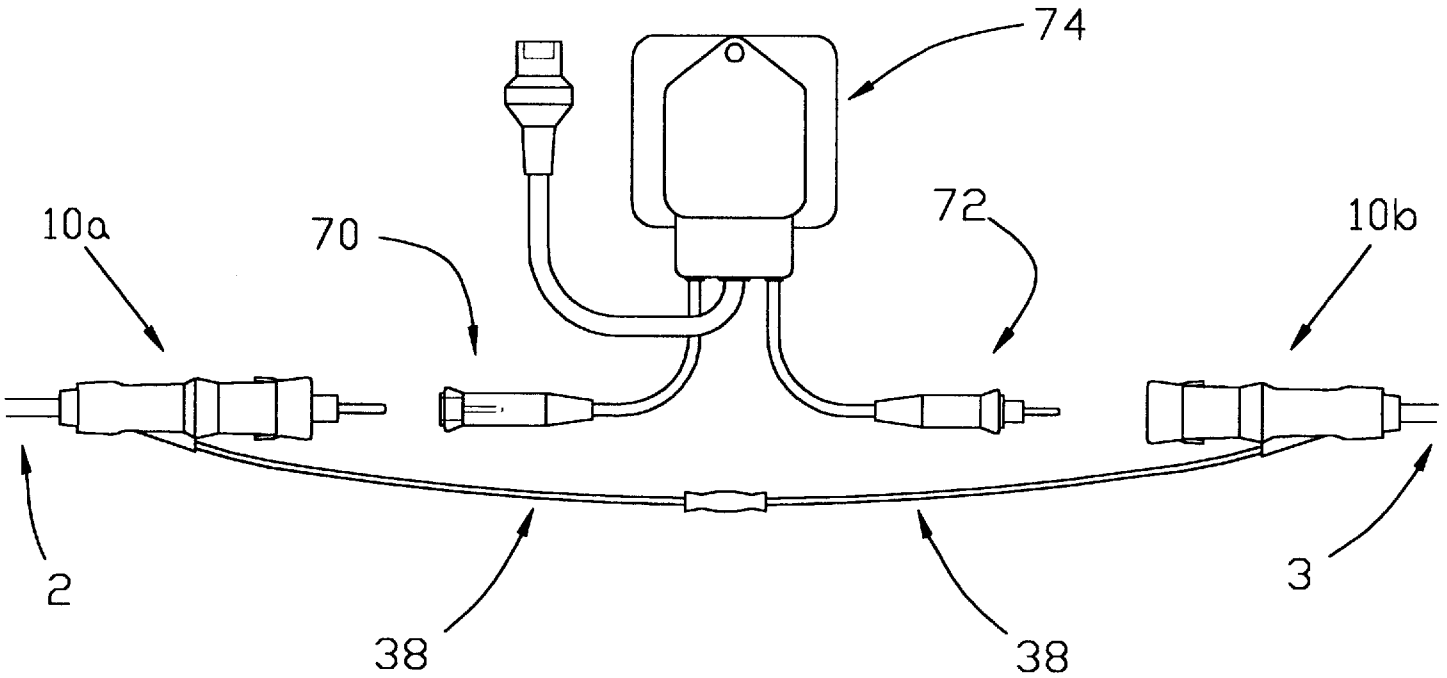
FIG. 7 shows two shielded cables connected to a series isolating transformer.

FIG. 7 shows a further embodiment of the present invention where the pin connector 10*a* is connecting the first cable 2 to a first connector 70 of a series isolating transformer 74. FIG. 7 further shows the socket connector 10*b* being connected to a second connector 72 of the series isolating transformer 74. However, as shown in FIG. 7, the cable shields 8 of the two cables 2, 3, are connected directly to each other by shield connectors 38. In a further embodiment, not shown, the shield connectors 38 could both be grounded to a common ground with the connectors 10*a* and 10*b* connected to the first and second connectors 70, 72 of a series isolating transformer 74. Therefore, the connectors 10*a*, 10*b* need not connect the conductors 6 and the shields 8 of the cables 2, 3 to the same electrical elements.

It is understood that the first resilient opening 18 may not be resiliently deformable from the unbiased position to the biased position. It is only necessary that the first resilient opening 18 be resiliently deformable, or otherwise contractible, from the biased position to a contracted position which can frictionally hold the cable 2. While a resilient opening 18 is a preferred embodiment, other types of contractible openings, as is known in the art, such as heat shrinking or clamping, can be used. Furthermore, it is understood that the opening 18 need not be cylindrical, but could have any type of inner dimension and cross section which provides a good interference fit to the cable 2 being used.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

The embodiments of the invention in which an exclusive property or privilege is claimed are defined as follows:

1. An electrical connector for connecting a first shielded cable to a first electrical element and a second electrical element, said first shielded cable comprising a first insulated conductor having an outer diameter and a first cable shield applied over the first insulated conductor, said electrical connector comprising:

a first longitudinally extending connector housing;

a resilient opening extending longitudinally into a first end of the connector housing for longitudinally receiving the first shielded cable, said resilient opening having an inner diameter and being resiliently deformable from a biased position, permitting insertion of the first cable, to an unbiased position, wherein the inner diameter is smaller than the outer diameter of the first insulated conductor;

shield connecting means located on an inside surface of said resilient opening at a longitudinal position along said first connector housing such that said shield connecting means is not in electrical contact with the first cable shield of the first cable while the resilient opening is in the biased position and the shielded connecting means is resiliently deformable with the resilient opening to come into electrical contact with the first cable shield when the resilient opening is permitted to resiliently deform about the first cable;

shield coupling means electrically connected to the shield connecting means and electrically connectable to the second electrical element;

wherein the resilient opening is biased to the biased position to permit insertion of the first cable into the connector housing, and, wherein upon insertion of the first cable to an inserted position, the resilient opening is permitted to resiliently deform about the first cable such that the resilient deformation causes the first cable to become frictionally held in said resilient opening and the shield connecting means to come into electrical contact with the cable shield of the first cable.

2. The electrical connector as defined in claim 1 wherein a portion of said shield is exposed such that the exposed portion is coincident with the longitudinal position of the shield connecting means when the first insulated conductor is in the inserted position.

3. The electrical connector as defined in claim 1 further comprising:

biasing means for biasing the resilient opening to the biased position; and wherein the biasing means biases the resilient opening to the biased position permitting longitudinal insertion of the first cable, and, upon insertion of the first cable to the inserted position, the biasing means is removed to cause the resilient opening to resiliently deform about the first cable.

4. The connector as defined in claim 3 wherein the shield connecting means comprises resilient spring clip means located at the longitudinal position on the inside surface of said resilient opening and resiliently deformable therewith; and wherein said shield coupling means comprises a first shield conductor electrically connected to the resilient spring clip means and passing through to an outer surface of the housing.

5. The electrical connector as defined in claim 4 wherein said resilient opening comprises rib means at the longitudinal position; and wherein the spring clip means abut the rib means.

6. The electrical connector as defined in claim 5 wherein said connector housing comprises a passage extending longitudinally from the resilient opening at the first end to a second opening at the second end; and wherein the second opening comprises locking means for locking said first cable in the inserted position.

7. The connector as defined in claim 6 wherein the first conductor has a first electrical contact attached thereto prior to the first conductor being inserted into the resilient opening.

8. The connector as defined in claim 7 wherein the first electrical contact comprises a radial groove at an axial location such that the radial groove is coincident with the locking means when the first insulated conductor is in the inserted position; and wherein the locking means comprises a lock washer imbedded in the housing such that the lock washer engages the radial groove of the first electrical contact to lock the first cable in the inserted position.

9. The connector as defined in claim 8 wherein the first electrical element is a second insulated conductor of a second shielded cable, said second insulated conductor having a second cable shield applied thereover and the second electrical element is the cable shield of the second shielded cable;

wherein the first longitudinally extending connector housing mates with a second longitudinally extending housing within which the second cable is contained;

wherein the first electrical contact mates with a second electrical contact attached to the second insulated conductor;

wherein the first shield conductor is electrically connectable to a second shield conductor which is electrically coupled to the second cable shield of the second cable and extends from an outer surface of the second housing; and wherein when the first housing is mated with the second housing, the first electrical contact is mated with the second electrical contact and the first shield conductor is electrically connected to the second shield conductor, the first shielded cable is electrically connected to the second shielded cable.

10. The connector as defined in claim 5 wherein the biasing means is a rigid member inserted into the first resilient opening at a time of manufacture, said rigid member having an outer diameter corresponding to the inner diameter of the resilient opening in the biased position, and having a shoulder wherein, before insertion of the rigid member into the resilient opening, the clip means is placed in abutted relation to the shoulder such that insertion of the rigid member into the resilient opening moves the clip to the longitudinal position and adjacent the rib means.

11. The connector as defined in claim 10 wherein the connector assembly is waterproof; and wherein the second cable emanates from a series isolating transformer.

12. An electrical connector for connecting a first shielded cable to a first electrical element, said first shielded cable having an outer diameter and comprising an insulated conductor and a cable shield applied over the insulated conductor, said electrical connector comprising:

a connector housing;

contractible opening means extending longitudinally into a first end of the connector housing for longitudinally receiving the first shielded cable, said contractible opening means having an inner dimension from a biased position permitting insertion of the first cable, to an unbiased position wherein the inner dimension is smaller than the outer diameter of the first shielded cable;

shield connecting means located on an inside surface of said opening means at a longitudinal position along said connector housing and contractible with the contractible opening;

shield coupling means electrically connected to the shield connecting means and electrically connectable to a second electrical element; and wherein the first shielded cable, having the shield conductor exposed but not in electrical contact with the shield connecting means, is longitudinally inserted into the contractible opening means, and, wherein upon insertion of the first shielded cable to an inserted position, the contractible opening is contracted about the first shielded cable which causes the first shielded cable to become frictionally held in said contractible opening and causes the shield connecting means to come into electrical contact with the cable shield of the first cable.

13. A method for connecting a first shielded cable to a first electrical element and a second electrical element, said first shielded cable comprising an insulated conductor and a cable shield applied over the insulated conductor, said method comprising the steps of:

inserting said first cable into a contractible opening of a connector housing, said opening extending longitudinally into a first end of the connector housing and having an initial inner dimension from abiased position, permitting insertion of the first cable, said opening further having shield connecting means formed on an inside surface of said opening at a longitudinal position along said first connector housing, said shield connecting means not being in electrical contact with the cable shield of the first cable when the contractible opening has the initial inner dimension, said shield connecting means being electrically connected to the shield coupling means and electrically connectable to the second electrical element;

when the first cable is in an inserted position in the connector housing, contracting the contractible opening about the first shielded cable from the initial inner dimension to a contracted dimension, wherein the contracted dimension is smaller than an outer diameter of the first shielded cable such that the first cable is frictionally held in said contractible opening and the shield connecting means comes into electrical contact with the cable shield of the first shielded cable;

electrically connecting the shield coupling means to the second electrical element; and electrically connecting the insulated conductor of the first cable to the first electrical element.

14. The method as defined in claim 13 further comprising the step of exposing a portion of the shield such that the exposed portion is coincident with the longitudinal position of the shield connecting means when the first conductor is in the inserted position.

15. The method as defined in claim 14 wherein the shield connecting means comprises resilient spring clip means located on an inside surface of said contractible opening means and contractible therewith; and wherein said shield coupling means comprises a shield conductor electrically connected to the resilient spring clip means and passing through to an outer surface of the housing.

16. The method as defined in the claim 15 further comprising the step of attaching a first electrical contact to the first conductor prior to inserting the first cable into the contractible opening.

17. The method as defined in the claim 16 wherein the first electrical element is a second insulated conductor of a second shielded cable and the second electrical element is a second cable shield of the second shielded cable applied over the second insulated conductor.

18. A method for making an electrical connector which can connect a shield conductor to the shield of a shielded cable, said shielded cable comprising an insulated conductor having an outer diameter and a cable shield applied over the insulated conductor, said method comprising the steps of:

(a) attaching the shield conductor to a clip means;

(b) wrapping the clip means around a rigid member such that the clip means can be moved axially with the rigid member;

(c) axially inserting the rigid member, clip means and shield conductor into a first resilient opening extending longitudinally into the electrical connector, such that the first resilient opening is resiliently deformed by the rigid member from an unbiased position, wherein an inner diameter of the opening is smaller than the outer diameter of the insulated conductor, to a biased position, permitting insertion of the first cable;

wherein upon insertion of the shielded cable into the opening, the rigid member can be removed permitting the resilient opening to resiliently deform about the shielded cable such that the shielded cable is frictionally held in said resilient opening and the clip means is in electrical contact with the cable shield.

19. The method of claim 18 wherein the clip means is resilient such that, upon removal of the rigid member, the clip means resiliently deforms aboutthe cable shield to come into electrical contact therewith.

20. The method of claim 18 further comprising the steps of:

passing the shield conductor through a second resilient opening in the housing during insertion of the shield conductor, clip means and rigid member into the first resilient opening, wherein shield conductor forms an interference fit with the second resilient opening.

21. The method of claim 19 further comprising the steps of:

abutting the clip means to a shoulder on the rigid member to facilitate axial movement of the clip means into the first resilient opening; and inserting the clip means to a longitudinal location in the first resilient opening corresponding to a location of rib means formed on an inside surface of the first resilient opening.

22. The method of claim 21 wherein the rib means cause the first resilient opening to have greater resiliency and less friction at the location of the rib means, and wherein the second resilient opening is located proximate the rib means.

* * * * *